US011266228B2

(12) United States Patent
Friend et al.

(10) Patent No.: US 11,266,228 B2
(45) Date of Patent: Mar. 8, 2022

(54) SONIC MAKEUP BRUSH

(71) Applicant: Michael Todd Beauty LP, Port St. Lucie, FL (US)

(72) Inventors: Michael Friend, Port St. Lucie, FL (US); NengFei Xu, Zhejiang (CN)

(73) Assignee: Michael Todd Beauty LP, Port St. Lucie, FL (US)

( * ) Notice: Subject to any disclaimer, the term of this patent is extended or adjusted under 35 U.S.C. 154(b) by 235 days.

(21) Appl. No.: 16/483,470

(22) PCT Filed: Feb. 16, 2018

(86) PCT No.: PCT/US2018/018477

§ 371 (c)(1),
(2) Date: Aug. 5, 2019

(87) PCT Pub. No.: WO2018/152393

PCT Pub. Date: Aug. 23, 2018

(65) Prior Publication Data

US 2020/0008570 A1 Jan. 9, 2020

Related U.S. Application Data

(60) Provisional application No. 62/461,022, filed on Feb. 20, 2017.

(51) Int. Cl.

| | |
|---|---|
| ***A46B 13/02*** | (2006.01) |
| ***A46B 7/04*** | (2006.01) |
| ***A46B 9/02*** | (2006.01) |

(52) U.S. Cl.

CPC ..... *A46B 13/023* (2013.01); *A46B 7/04* (2013.01); *A46B 9/021* (2013.01); *A46B 2200/1046* (2013.01)

(58) Field of Classification Search

CPC ..... A46B 13/023; A46B 13/02; A46B 13/00; A46B 9/021; A46B 2200/102;

(Continued)

(56) References Cited

U.S. PATENT DOCUMENTS

2015/0034113 A1 2/2015 Yamagishi et al.
2015/0333609 A1* 11/2015 Lattanzi ..... A46B 13/026 310/38

(Continued)

OTHER PUBLICATIONS

Michael Todd Sonicblend Antimicrobial Sonic Foundation Makeup Brush for Blending, Contouring and Airbrush Finish (Black). Amazon.com, Amazon.co, Inc., Jan. 4, 2017. The figure and first and second paragraphs on p. 1. www.amazon.com/Michael-Todd-Sonicblend-Antimicrobial-Foundation/dp/B01 IRGH3L2?th= 1.

*Primary Examiner* — Shay Karls
(74) *Attorney, Agent, or Firm* — Philip E. Levy; Eckert Seamans Cherin & Mellott, LLC

(57) ABSTRACT

A makeup brush includes a housing having a longitudinal axis, and a drive assembly provided within the housing. The drive assembly includes a stator assembly and an armature assembly adjacent the stator assembly, the armature assembly including a mounting member held by the housing and a pivot arm member pivotably coupled to the mounting member, the pivot arm member being structured to pivot with respect to the mounting member about an axis that is parallel to the longitudinal axis, wherein the stator, when energized, is structured to cause the pivot arm member to pivot with respect to the mounting member. The makeup brush also includes a brush head member having a plurality of bristles and being coupled to the pivot arm member such that pivoting movement of the pivot member causes the brush head member to oscillate relative to the housing.

9 Claims, 4 Drawing Sheets

(58) Field of Classification Search
CPC ..... A46B 2200/1046; A46B 7/02; A46B 7/04; A46B 7/06; A46B 7/10; A45D 40/262; A45D 34/042; A45D 2200/207
See application file for complete search history.

(56) References Cited

U.S. PATENT DOCUMENTS

| | | | | |
|---|---|---|---|---|
| 2016/0183671 | A1 | 6/2016 | Skidmore | |
| 2016/0270821 | A1* | 9/2016 | Hendler | A61B 17/54 |
| 2016/0302560 | A1 | 10/2016 | Takata et al. | |
| 2016/0324306 | A1 | 11/2016 | Martin et al. | |
| 2017/0013951 | A1 | 1/2017 | Peterson | |

* cited by examiner

SONIC MAKEUP BRUSH

CROSS-REFERENCE TO PRIOR APPLICATIONS

This application is a U.S. National Stage Application under 35 U.S.C. § 371 of PCT International Application No. PCT/US2018/018477, filed on Feb. 16, 2018, which claims priority under 35 U.S.C. § 119(e) to U.S. Provisional Patent Application No. 62/461,022, filed Feb. 20, 2017, entitled "SONIC MAKEUP BRUSH," which is herein incorporated by reference.

BACKGROUND OF THE INVENTION

1. Field of the Invention

The present invention relates to brushes for applying makeup to the face of an individual, and, in particular, a makeup brush that applies makeup at sonic speeds (e.g., 200 cycles/second), and that, in particular embodiments, has built-in protection against microbial contamination so that the brush stays cleaner and fresher longer.

2. Description of the Related Art

It is known to apply makeup, such as foundation, to the face of an individual using a makeup brush. Such makeup brushes typically include a handle having a brush head attached thereto that includes a plurality of natural and/or synthetic bristles. Makeup is applied by dipping the brush head in a makeup composition, such as foundation, and sweeping the brush head across the face of the individual. With such makeup brushes, it can be difficult to apply makeup so that individual has a natural look. Often times, application of makeup using known makeup brushes results in undesirable lines or streaks on the individual's face.

SUMMARY OF THE INVENTION

In one embodiment, a makeup brush is provided that includes a housing having a longitudinal axis, and a drive assembly provided within the housing. The drive assembly includes a stator assembly and an armature assembly adjacent the stator assembly, the armature assembly including a mounting member held by the housing and a pivot arm member pivotably coupled to the mounting member, the pivot arm member being structured to pivot with respect to the mounting member about an axis that is parallel to the longitudinal axis, wherein the stator, when energized, is structured to cause the pivot arm member to pivot with respect to the mounting member. The makeup brush also includes a brush head member having a plurality of bristles and being coupled to the pivot arm member such that pivoting movement of the pivot member causes the brush head member to oscillate relative to the housing.

DETAILED DESCRIPTION OF EXEMPLARY EMBODIMENTS

Figure 1:
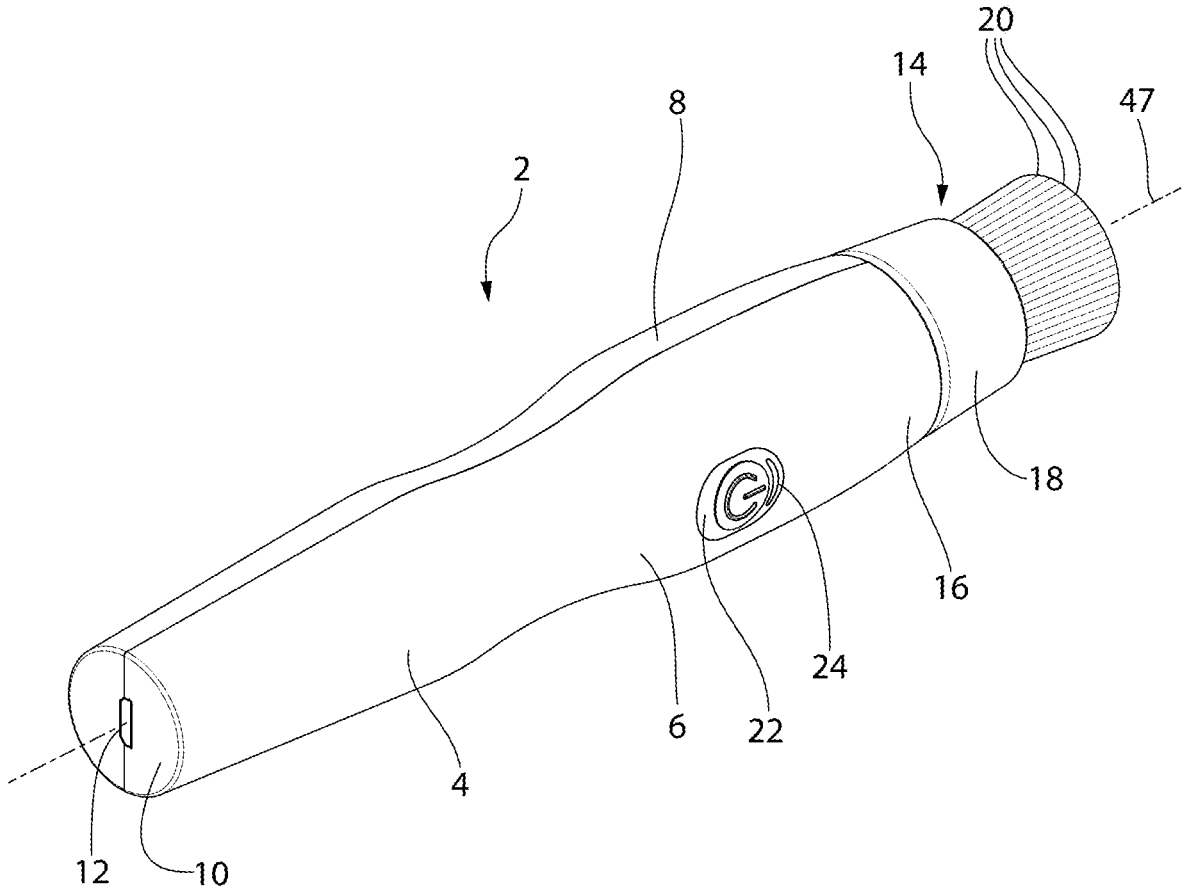
FIG. 1 is a rear isometric view and FIG. 2 is an exploded view of a makeup brush according to an exemplary embodiment of the disclosed concept.

As used herein, the singular form of "a", "an", and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body.

As used herein, the statement that two or more parts or components "engage" one another shall mean that the parts exert a force against one another either directly or through one or more intermediate parts or components.

As used herein, the term "number" shall mean one or an integer greater than one (i.e., a plurality).

As used herein, a "cycle" shall refer to movement (e.g., oscillation) of a brush head from a first lateral (e.g., left) maximum position to an opposite second lateral (e.g., right) maximum position and back to the first lateral (e.g., left) maximum position. As will be appreciated, in operation, a bush head may oscillate by starting from an initial midpoint (resting) position before moving to the first lateral (e.g., left) maximum position. In such a case, the first "cycle" would begin when the brush head reaches the first lateral (e.g., left) maximum position after starting from the initial midpoint position.

As used herein, the term "sonic" shall mean speeds of 20 to 20,000 cycles/second.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

The present invention will now be described, for purposes of explanation, in connection with numerous specific details in order to provide a thorough understanding of the subject invention. It will be evident, however, that the present invention can be practiced without these specific details without departing from the spirit and scope of this innovation.

The disclosed concept provides a powered makeup brush that is structured to apply makeup at sonic speeds. The disclosed makeup brush provides enhanced comfort and control, and uses gentle sonic movements to easily sweep makeup, such as foundation, onto the face of the user without leaving lines or streaks. The result is a natural looking, airbrushed-like application of makeup to the user's face. The sonic movement also provides for better makeup coverage, allowing the individual to use less makeup at each application. In addition, the disclosed makeup brush helps to improve the overall health and condition of the user's skin by minimizing clogged pores and irritation that often results from the rubbing and stretching of the skin that commonly occurs during use of traditional makeup brushes. The brush head faces in a direction that is parallel to the longitudinal axis of the handle such that the bristles themselves extend in the direction that is parallel to the longitudinal axis of the handle and the brush head oscillates about an axis that is parallel to the longitudinal axis of the handle in directions that are transverse to the longitudinal axis.

Figure 2:
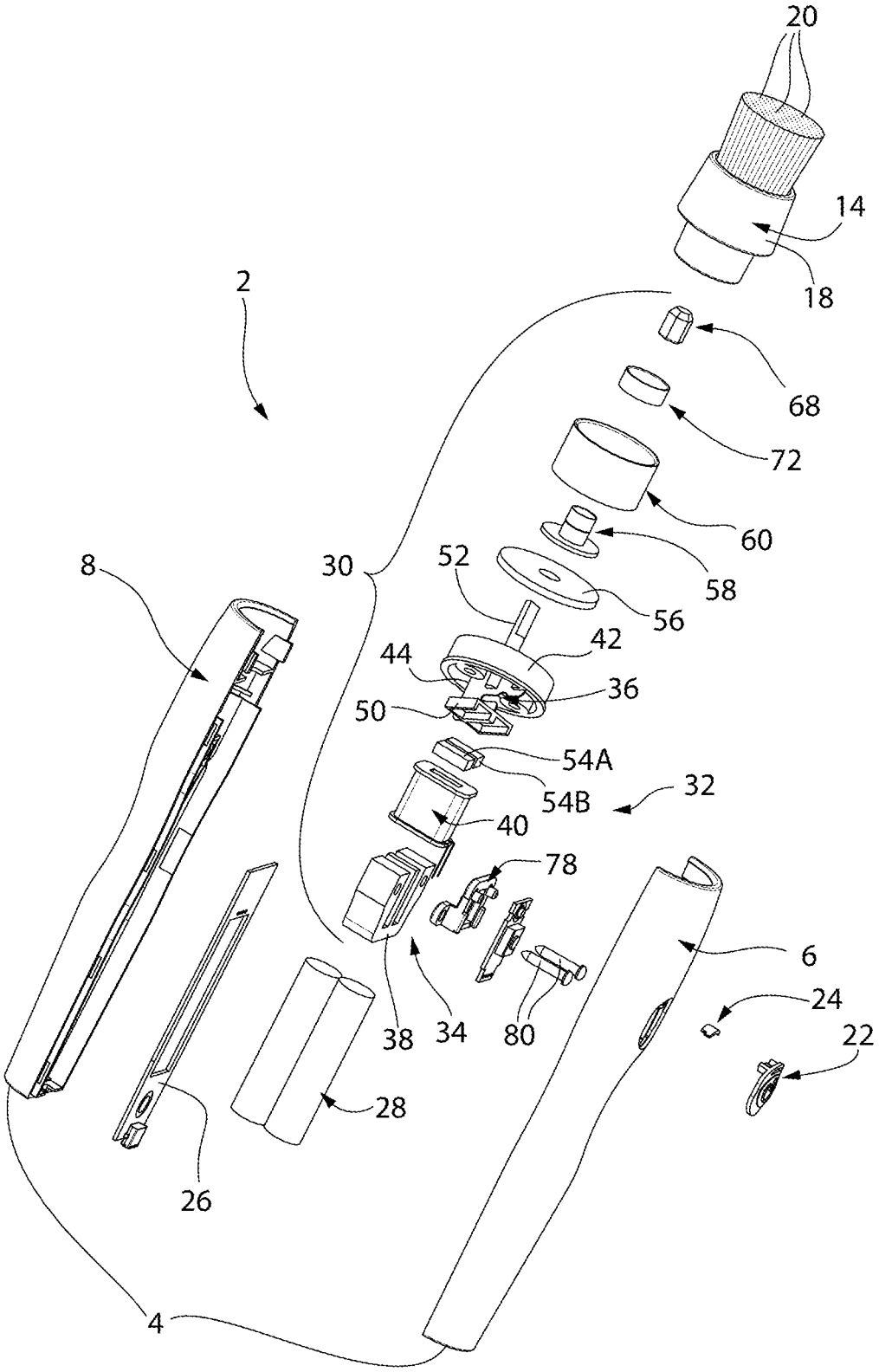

FIG. 1 is a rear isometric view and FIG. 2 is an exploded view of a makeup brush 2 according to an exemplary embodiment of the disclosed concept. In the illustrated embodiment, makeup brush 2 includes a handle portion 4 comprising a two-part main housing having a front housing portion 6 and a rear housing portion 8 coupled to the front housing portion 6. A first end 10 of handle portion 4 includes a charging port 12, such as a USB charging port, to enable a rechargeable battery (described herein) of makeup brush 2 to be recharged. A brush head member 14 is securely and releasably attached to a second end 16 of handle portion 4 in a manner that permits brush head member 14 oscillate with respect to handle portion 4 during use as described in detail herein.

As seen in FIGS. 1 and 2, brush head member 14 includes a base member 18 and a plurality of bristles 20 attached to the base member 18. In the exemplary embodiment, bristles 20 are arranged on and extend from base member 18 and form a circular brushing surface. In one particular exemplary embodiment, the length from the bottom of base member 18 to the distal end of each bristle 20 is 55 mm long.

Because of the presence of microbes such as bacteria and fungi in all walks of human life, there is a constant interaction between microbes and humans. This is especially so in brush head member 14, where skin cells left on bristles 20 provide a food source for microorganisms, which when combined with moisture and light, provide a breeding ground for the growth of mold, mildew and fungus, as well as, microbes, pathogens and bacteria, such as *E. coli* and Staph, and other microorganisms. Tests have shown that on unprotected surfaces, bacteria can double in number every 20 minutes.

Thus, in one non-limiting exemplary embodiment, the components of the brush head member 14 including, without limitation, bristles 20, are made with active ingredients during the manufacturing stage that are both (i) safe for use on the skin, and (ii) resist and inhibit the growth of mold, mildew, fungus and/or bacteria on brush head member 14, keeping brush head member 14 cleaner and healthier for a longer period of time. By helping prevent the growth of microorganisms, stain and odor control is also achieved.

Such active ingredients may include, for example and without limitation, silver ion technology (wherein silver ions are incorporated as an additive at the time of manufacture, or applied as a coating after manufacture), which forms a safe protective antimicrobial surface to resist and inhibit bacterial growth by up to 99.94%. Such active ingredients may further include, without limitation, essential plant oils (e.g., cinnamon oil, clove oil, eucalyptus oil, oregano oil, lavender oil, leleshwa oil, lemon oil, lemon myrtle oil, mint oil, neem oil, nigella sativa (black cumin) oil, peppermint oil, sandalwood oil, ironwort oil, tea tree oil, and thyme oil), and essential minerals, or bacteria resistant polymers (e.g., a polymer that reduces the ability of pathogenic bacteria to attach to the polymer).

An actuator mechanism 22 comprising a rubber button is provided on handle portion 4 for controlling the operation of makeup brush 2 (i.e., controlling the starting, stopping and/or speed of the movement of brush head member 14 as described herein). In addition, handle portion 4 also includes an indicator light 24 for providing an indication of when makeup brush 2 is being actively charged.

As noted elsewhere herein, FIG. 2 is an exploded view of makeup brush 2 that allows the internal components of makeup brush 2 to be readily viewed. As seen in FIG. 2, makeup brush 2 includes a main circuit board 26 that is mounted and held within handle portion 4. Main circuit board 26 includes the control electronics (including a processing device such as, without limitation, a microprocessor or a microcontroller and associated memory) which control the operation of makeup brush 2. A rechargeable battery 28 is coupled to main circuit board 26 and is adapted to provide power for makeup brush 2.

In addition, as seen in FIG. 2, a drive assembly 30 is mounted and held within handle portion 4. Brush head member 14 is structured to be selectively attached to drive assembly 30 so that, as described in more detail below, drive assembly 30 is able to move brush head member 14 in an oscillating manner with respect to handle portion 4.

As seen in FIG. 2, drive assembly 30 includes an electric motor 32 that is coupled to main circuit board 26 and rechargeable battery 28 by wires (not shown). Motor 32 includes a stator assembly 34 and an armature assembly 36.

Stator assembly 34 includes an E-core member 38 having first and second outer legs and a center leg in between the outer legs, and a stator coil member 40 (including a coil holder and a copper coil) provided around the center leg of E-core member 38.

Figure 3:
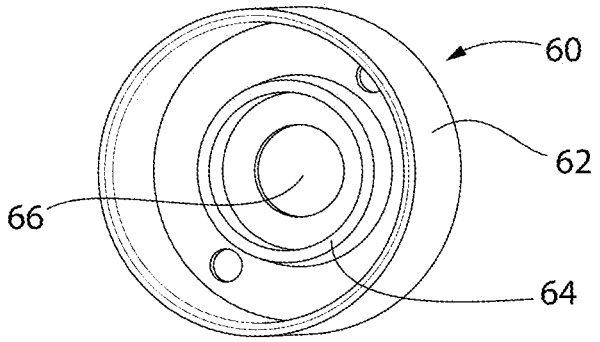
FIG. 3 is an isometric view showing portions of an armature assembly of the makeup brush of FIGS. 1 and 2.

Armature assembly 36 includes a mounting member 42 (FIG. 3) structured to be received and held within second end 16 of handle portion 4. Armature assembly 36 further includes a pivot arm member 44 pivotably coupled to mounting member 42. As seen in FIG. 3, pivot arm member 44 includes a generally flat, planar main body portion 46 that is structured to extend in a plane that is perpendicular to the longitudinal axis 47 of makeup brush 2 when makeup brush 2 is assembled. Main body portion 46 includes a mounting arm 48 that extends therefrom. Mounting arm 48 is fixedly attached to mounting member 42. The side of main body portion 46 directly opposite mounting arm 48 is not attached to mounting member 42 (i.e., it "floats"). As such, pivot arm member 44 is structured to pivot with respect to mounting member 42 about an axis that is parallel to the longitudinal axis 47 of makeup brush 2. Pivot arm member 44 further includes a magnet holding member 50 having a pair of recesses that is provided at a first end of pivot arm member 44, and a shaft member 52 provided at a second end of pivot arm member 44 opposite the first end. As seen in FIG. 3, shaft member 52 extends from main body portion 46 through a central hole provided in mounting member 42. When makeup brush 2 is assembled, shaft member 52 extends in a direction that is parallel to and coaxial with longitudinal axis 47 of makeup brush 2. In the exemplary embodiment, mounting number 42 and arm member 44 are made from a zinc alloy material for providing maximum strength.

Armature assembly 36 further includes first and second magnets 54A, 54B that are spaced apart from one another and that are coupled to magnet holding member 50. In particular, first and second magnets 54A, 54B are received and held within respective recesses provided in magnet holding member 50. First and second magnets 54A, 54B are oriented such that the poles of first and second magnets 54A, 54B face in opposite directions (e.g., the N pole of magnet 54A faces stator assembly 34 and the S pole of magnet 54B faces stator assembly 34).

When assembled, both stator assembly 34 and armature assembly 36 are held within handle portion 4 in a manner such that magnet holding member 50 and first and second magnets 54A, 54B are adjacent to but slightly spaced from the top side of E-core member 38.

Figure 4:
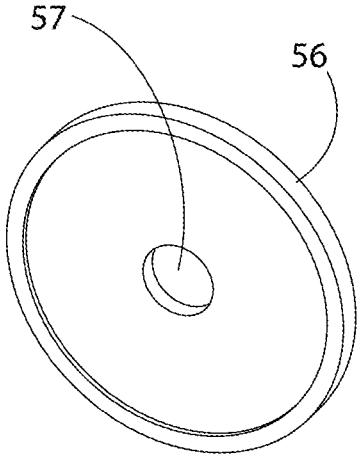
FIG. 4 is an isometric view of a motor clapboard of the makeup brush of FIGS. 1 and 2.
Figure 6:
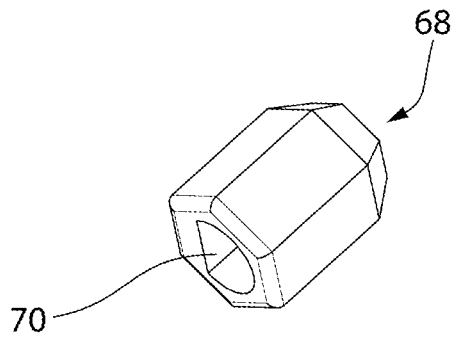
FIG. 6 is an isometric view of a brush head holding member of the makeup brush of FIGS. 1 and 2.

Drive assembly 30 further includes a circular motor clapboard 56 (FIG. 4) that is coupled to armature assembly 36 by inserting shaft member 52 through a central aperture 57 of motor clapboard 56. As a result, motor clapboard 56 will rest on top of mounting member 42. Drive assembly 30 also includes a flexible ring member 58 made of an elastomeric material such as, without limitation, silicone or rubber. As seen in FIG. 2, flexible ring member 58 includes a circular base portion and a cylindrical portion extending from the circular base portion. Flexible ring member 58 is coupled to armature assembly 36 over top of circular motor clapboard 56 in a manner wherein shaft member 52 is received through a central bore of flexible ring member 58. Drive assembly 30 still further includes a brush head holding member 68 as shown in FIG. 6. Brush head holding member 68 is attached to the distal end of shaft member 52 on top of and in abutting engagement with flexible ring member 58. In particular, as seen in FIG. 6, brush head holding member 68 includes a D-shaped bore 70 that is structured to receive a D-shaped distal end of shaft member 52 therein.

Figure 5:
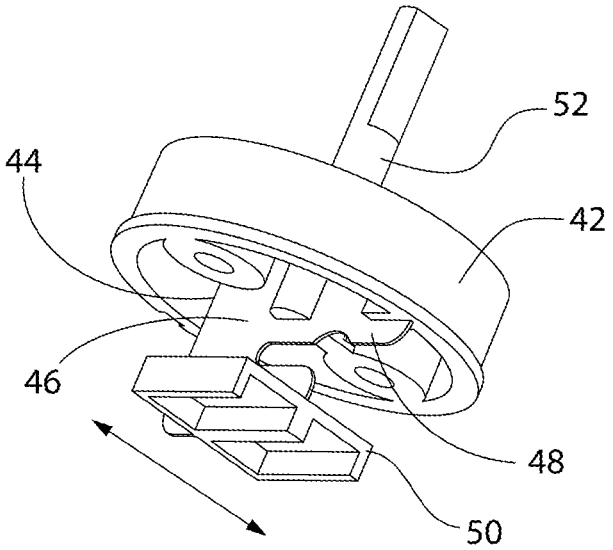
FIG. 5 is an isometric view of a shockproof ring member of the makeup brush of FIGS. 1 and 2.

Drive assembly 30 also further includes a shockproof ring 60 as shown in FIG. 5. In the exemplary embodiment, shockproof ring 60 is made of a thermoplastic polymer material, such as, without limitation, acrylonitrile butadiene styrene (ABS). Shockproof ring 60 includes an outer cylindrical wall 62, an inner cylindrical wall 64, and a central aperture 66. A waterproof ring 72 made of a flexible elastomeric material, such as, without limitation, silicone or rubber, is provided within inner cylindrical wall 64. Shockproof ring 60 having waterproof ring 72 provided therein is coupled to armature assembly 36 by inserting shaft member 52 (surrounded by flexible ring member 58 and brush head holding member 68 as described herein) through central aperture 66 and through waterproof ring 72.

When assembled as just described, shockproof ring 60 will reside within the open end of second end 16 of handle portion 4. As such, outer cylindrical wall 62 defines a receiving recess that includes at the center thereof brush head holding member 68 attached to the distal end of shaft member 52 (those two components extend through waterproof ring 72).

Figure 7:
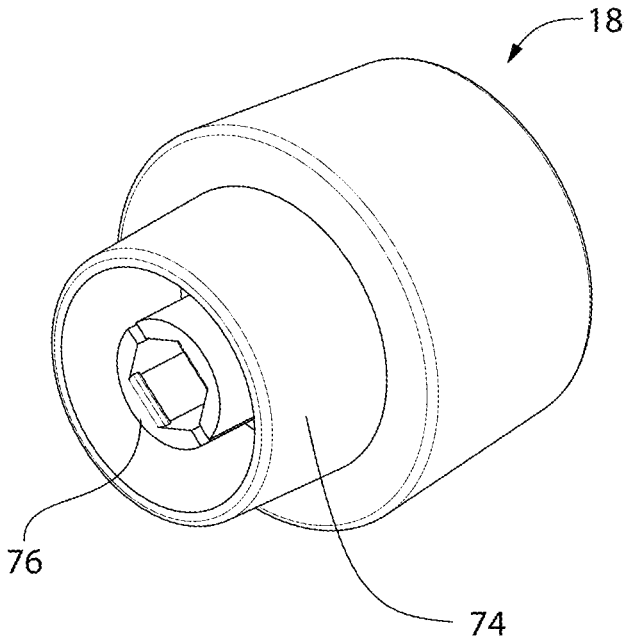
FIG. 7 is an isometric view of a base member of the brush head member of the makeup brush of FIGS. 1 and 2.

FIG. 7 is an isometric view of base member 18 of brush head member 14. As seen in FIG. 7, base member 18 includes a lower cylindrical portion 74 that includes therein a receiving member 76. Receiving member 76 comprises a plurality of spaced extension members that are arranged in a circular fashion. Receiving member 76 is structured to receive therein and securely hold brush head holding member 68. Thus, brush head member 14 maybe selectively and securely attached to handle portion 4 by inserting lower cylindrical portion 74 of base member 18 into outer cylindrical wall 62 that, as described herein, is provided in the second end 16 of handle portion 4 in a manner wherein brush head holding member 68 (and therefore the distal end of shaft 52) is received within receiving member 76. As will be appreciated, such an attachment will result in brush head member 14 being operatively coupled to drive assembly 30 in a manner wherein brush head member 14 is free to pivot with respect to handle portion 4 as a result of being operatively coupled to pivot arm 44.

Finally, makeup brush 2 includes a button holder member 78 that is coupled to E-core member 38 by screws 80. A button chip 84 is held by the button member 78. Button chip 84 is structured to be actuated by actuation member 22.

In operation, when power is provided to motor 32 by rechargeable battery 28, pivot arm member 44 will be caused to oscillate back and forth in an arcuate path as a result of the changing magnetic field produced in stator assembly 34 and the interaction of magnets 54A, 54B therewith. As a result, shaft member 52 will be caused to oscillate, which will cause brush head member 14, coupled to shaft member 52 as described herein, to oscillate with respect to handle portion 4. A user may then apply the oscillating bush head member 14 (having makeup thereon) to different areas of the face to thereby sweep the makeup onto the face without leaving lines or streaks. As described elsewhere herein, the drive assembly 30 is structured to operate at sonic speeds so as to provide better makeup coverage with increased comfort and less irritation and clogging pores.

In one particular exemplary embodiment, the control electronics of main circuit board 26 are configured to control motor 32 such that when a first half cycle (e.g., the positive half cycle) of the AC current is generated from battery 28 during each period (each complete cycle) of the AC current, it is provided to E-core member 38 to energize/magnetize E-core member 38, and when a second, opposite half cycle (e.g., the negative half cycle) of the AC current is generated from battery 28 during each period (each complete cycle) of the AC current, it is not provided to the E-core member 38. As a result, during each first half cycle of the AC current, E-core member 38 will have polarities which will cause pivot arm member 44 to be driven in a first direction. In addition, during each second, opposite half cycle of the AC current, E-core member 38 will not be energized, and as a result, pivot arm member 44 will move in the opposite direction as a result of the natural flexing of pivot member 44 (i.e., pivot arm member 44 is not driven in this direction by motor 32). In this alternative embodiment, the present inventors have found that particularly advantageous performance can be obtained by utilizing an E-core member 38 comprising a stack of a plurality of shaped metal sheets or plates (e.g., silicon steel sheet).

In another particular exemplary embodiment, the control electronics of main circuit board 26 are configured to control motor 32 such that during each cycle of oscillation of brush head member 14, the center of magnet holding member 50 is caused to move to a first lateral (e.g., right) maximum position that is 2.5 mm from an initial midpoint position and a second lateral (e.g., left) maximum position that is 2.5 mm, or, alternatively, 2.0 mm, from the initial midpoint position. In such a configuration, and with the length from the bottom of base member 18 to the distal end of each bristle 20 being 55 mm as described herein, the distal end of each bristle 20 will be caused to move 8 to 10 mm in the lateral direction. Thus, in this embodiment, the ratio of movement of the distal end of each bristle 20 in the lateral direction to the movement of the center of magnet holding member 50 in the lateral direction is between 4 to 1 and 3.2 to 1. In other embodiments, that same ratio may be between 4.4 to 1 and 2.8 to 1. As used herein, "between" means that value may be equal to the upper or lower limits of range (e.g., the ratio may be equal to 4 or 3.2).

In the claims, any reference signs placed between parentheses shall not be construed as limiting the claim. The word.

"comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A makeup brush, comprising:

a housing having a longitudinal axis;

a drive assembly provided within the housing, the drive assembly including a stator assembly and an armature assembly adjacent the stator assembly, the armature assembly including a mounting member held by the housing and a pivot arm member pivotably coupled to the mounting member, the pivot arm member being structured to pivot with respect to the mounting member about an axis that is parallel to the longitudinal axis, wherein the stator, when energized, is structured to cause the pivot arm member to pivot with respect to the mounting member; and a brush head member having a plurality of bristles and being coupled to the pivot arm member such that pivoting movement of the pivot member causes the brush head member to oscillate relative to the housing;

wherein the pivot arm member includes a magnet holding member carrying a plurality of magnets, the magnet holding member being provided at a first end of the pivot arm member, and a shaft member provided at a second end of pivot arm member opposite the first end of the pivot arm member, wherein the shaft member extends from main body portion through a central hole provided in mounting member in a direction that is parallel to and coaxial with the longitudinal axis, wherein brush head member is coupled to the shaft member, wherein the drive assembly includes a first ring member, a second ring member, and a third ring member, wherein the second ring member includes an outer cylindrical wall, an inner cylindrical wall, and a central aperture, wherein the third ring member is held within the inner cylindrical wall, and wherein shaft member is received through the first ring member, the central aperture and the third ring member.

2. The makeup brush according to claim 1, wherein the pivot arm member includes a generally flat, planar main body portion that extends in a plane that is perpendicular to the longitudinal axis, wherein main body portion includes a mounting arm that extends therefrom and that is fixedly attached to the mounting member, and wherein a side of the main body portion directly opposite the mounting arm is not directly attached to the mounting member.

3. The makeup brush according to claim 1, wherein the first ring member and the third ring member are each made of an elastomeric material.

4. The makeup brush according to claim 3, wherein the first ring member includes a circular base portion and a cylindrical portion extending from the circular base portion.

5. The makeup brush according to claim 1, wherein the brush head member includes base member having a receiving member, wherein the drive assembly further includes a brush head holding member attached to a distal end of the shaft member on top of and in abutting engagement with the first ring member, wherein the brush head holding member is structured to be received within the receiving member.

6. The makeup brush according to claim 1, wherein each of the bristles has a length and a distal end, and wherein the length and the drive assembly are structured such that when the brush head member is caused to oscillate a ratio of movement of the distal end of each bristle in a lateral direction to movement of a center of the magnet holding member in the lateral direction is between 4.4 to 1 and 2.8 to 1.

7. The makeup brush according to claim 6, wherein the ratio is between 4 to 1 and 3.2 to 1.

8. The makeup brush according to claim 1, wherein the bristles include an antimicrobial material that is both (i) safe for use on the skin, and (ii) resists and/or inhibits the growth of mold, mildew, fungus and/or bacteria.

9. The makeup brush according to claim 1, wherein the stator, when energized, is structured to cause the pivot arm member to pivot with respect to the mounting member at a sonic speed.

* * * * *